US010753125B2

(12) United States Patent
Ogden et al.

(10) Patent No.: US 10,753,125 B2
(45) Date of Patent: Aug. 25, 2020

(54) LOCK MECHANISM

(71) Applicant: MOOSE JUNCTION LIMITED, Kidderminster, West Midlands (GB)

(72) Inventors: David Ogden, Kidderminster (GB); Simon Powell, Kidderminster (GB)

(73) Assignee: MOOSE JUNCTION LIMITED, Kidderminster (GB)

( * ) Notice: Subject to any disclaimer, the term of this patent is extended or adjusted under 35 U.S.C. 154(b) by 837 days.

(21) Appl. No.: 14/023,897

(22) Filed: Sep. 11, 2013

(65) Prior Publication Data

US 2015/0068257 A1 Mar. 12, 2015

(51) Int. Cl.

| | |
|---|---|
| ***E05B 47/06*** | (2006.01) |
| ***E05B 47/00*** | (2006.01) |
| *E05C 1/06* | (2006.01) |

(52) U.S. Cl.

CPC ..... *E05B 47/0607* (2013.01); *E05B 47/0005* (2013.01); *E05B 47/0012* (2013.01); *E05B 2047/0091* (2013.01); *E05B 2047/0094* (2013.01); *E05C 1/06* (2013.01); *Y10T 70/65* (2015.04); *Y10T 70/70* (2015.04)

(58) Field of Classification Search

CPC . E05C 1/06; Y10T 70/65; Y10T 70/70; E05B 47/0607; E05B 47/0005; E05B 47/0012; E05B 2047/0091; E05B 2047/0094

USPC ..... 70/223, 278.7, 379 R, 277, 278.1, 278.2, 70/278.3, 279.1, 280–283, 283.1; 292/153, 144

See application file for complete search history.

(56) References Cited

U.S. PATENT DOCUMENTS 1,226,720 A * 5/1917 Sturges ..... E05B 13/004 70/210
1,646,136 A * 10/1927 Booth ..... E05C 1/04 292/145

(Continued)

FOREIGN PATENT DOCUMENTS

EP 1859113 B2 11/2007
EP 1953774 A2 8/2008

(Continued)

OTHER PUBLICATIONS

Patents Act 1977: Search Report under Section 17 for German Patent Application No. 1204033.3, dated Jun. 14, 2012, 1 page.

(Continued)

*Primary Examiner* — Lloyd A Gall
(74) *Attorney, Agent, or Firm* — Reising Ethington, P.C.

(57) ABSTRACT

In one embodiment, a lock mechanism includes a control element arranged for rotation about an axis between an active position and an inactive position. The control element includes a control head having one or more axially extending projection(s). The lock mechanism further includes a lock element that is axially aligned with the control element and includes a lock element head. The lock element head has one or more axially extending projection(s). The projection(s) of the control head and the projection(s) of the lock element head are arranged such that in the active position, the lock element and control element are held apart by the projections, and such that in the inactive position, the projections can mesh together to permit axial movement of the lock element relative to the control element.

20 Claims, 3 Drawing Sheets

(56) References Cited

U.S. PATENT DOCUMENTS 1,819,813 A * 8/1931 Ellenberger ..... B60R 25/00 70/19
2,497,329 A * 2/1950 Smith ..... E05C 1/163 292/169.14
3,316,742 A * 5/1967 Wellekens ..... E05B 29/0013 70/223
3,469,875 A * 9/1969 Ahlgren ..... E05C 1/04 292/175
3,922,896 A * 12/1975 Kagoura ..... E05B 55/005 70/149
3,939,679 A * 2/1976 Barker ..... E05B 47/068 341/181
4,489,576 A * 12/1984 Mullich ..... E05B 63/0017 292/1.5
4,534,194 A * 8/1985 Aydin ..... E05B 47/068 70/276
4,625,848 A * 12/1986 Meyers ..... E05B 47/00 192/69.7
4,745,785 A * 5/1988 Uebersax ..... E05B 47/0012 70/279.1
4,807,454 A * 2/1989 Sengupta ..... E05B 47/063 70/277
4,818,000 A * 4/1989 Bobrowski ..... E05C 1/04 292/147
5,010,750 A * 4/1991 Boser ..... E05B 47/063 70/276
5,263,348 A * 11/1993 Wittwer ..... E05B 17/0058 70/223
5,265,453 A * 11/1993 Konii ..... E05B 17/04 70/360
5,295,377 A * 3/1994 Moricz ..... E05B 17/04 70/360
5,699,686 A * 12/1997 Neumayer ..... E05B 47/063 70/276
5,732,580 A * 3/1998 Garnault ..... E05B 17/04 70/360
5,987,818 A * 11/1999 Dabideen ..... E05B 17/0029 292/144
6,021,654 A * 2/2000 McCaa ..... E05B 13/101 292/336.3
6,035,676 A * 3/2000 Hudspeth ..... E05B 47/00 292/144
6,059,326 A * 5/2000 Tramontina ..... A47K 10/32 292/124
6,116,067 A * 9/2000 Myers ..... B25H 3/028 292/341.16
6,205,827 B1 * 3/2001 Lane ..... E05B 13/101 137/385
6,499,325 B1 * 12/2002 Hurskainen ..... E05B 47/0626 292/144
6,619,085 B1 9/2003 Hsieh
7,698,919 B2 * 4/2010 Kim ..... E05B 47/0012 70/277
7,938,765 B2 * 5/2011 Hayasaka ..... B04B 7/06 292/201
7,963,134 B2 * 6/2011 Rafferty ..... E05B 13/00 192/69.8
7,966,854 B2 * 6/2011 Imedio Ocana .... E05B 47/0642 192/69.62
7,997,109 B2 * 8/2011 Flandrinck ..... E05B 17/04 70/379 R
8,276,414 B2 * 10/2012 Luo ..... E05B 47/063 70/256
2001/0005998 A1 * 7/2001 Imedio Ocana ..... E05B 47/068 70/277
2002/0144526 A1 * 10/2002 Ming-Chih ..... E05B 47/068 70/218
2008/0190154 A1 8/2008 Flandrinck
2009/0314045 A1 * 12/2009 Giacomin ..... E05B 17/0058 70/237

FOREIGN PATENT DOCUMENTS

FR 2757204 A1 6/1998
GB 2005335 A 4/1979
GB 2488896 A 9/2012
WO 2006/092371 A1 9/2006

OTHER PUBLICATIONS

Extended European Search Report for Application No. 12183956.7-1609/2636822; dated Mar. 10, 2017; 7 pages.
English Abstract of FR 2757204, 1 page.

* cited by examiner

LOCK MECHANISM

TECHNICAL FIELD

This disclosure relates to a lock mechanism. It also relates to a lock incorporating the lock mechanism.

BACKGROUND

A typical lock comprises a lock bolt that is received within a keep when the lock is activated. When the lock is deactivated the lock bolt can be withdrawn from the keep. A lock mechanism is typically used to selectively restrict or control movement of a lock and/or control the lock bolt.

Certain locks and lock mechanisms, such as those for key boxes or safes and the like, are required to be particularly robust. These types of locks must be able to withstand large forces, particularly when attacked, yet still operate smoothly and reliably.

SUMMARY

A first embodiment of a lock mechanism may comprise a control element arranged for rotation about an axis between an active position and an inactive position. The control element may include a control head having one or more axially extending projection(s). The lock mechanism may further comprise a lock element that may be axially aligned with the control element and may include a lock element head. The lock element head may have one or more axially extending projection(s). The projection(s) of the control head and the projection(s) of the lock element head may be arranged such that in the active position, the lock element and control element may be held apart by the projections, and in the inactive position, the projections can mesh together to permit axial movement of the lock element relative to the control element.

This may be advantageous in some cases as the lock mechanism can be constructed such that it is very robust for its size. The intermeshing projections may provide an easy to manufacture and reliable way to control the motion of the lock element.

In some embodiments, the lock element may comprise an elongate body having the one or more projection(s) at one end and a lock bolt at an opposed end. The lock bolt may be adapted to be received within a keep of a lock. Alternatively, the lock element or lock bolt may be adapted to actuate a further mechanism of greater strength, for example.

In some embodiments, one or more of the projections may include a narrower tip that is narrower than the remainder of the projection or tapers. This may allow the projections to mesh together more easily as the tip, which could be conical or frustoconical, guides the projections to intermesh.

In some embodiments, the control head may have two or more axially extending projections, and the lock element head may have a complementary number of axially extending projections.

In some embodiments, the control head may be castellated and thus the castellations form the one or more projection(s). In some embodiments the lock element head may be castellated, the castellations on the lock element head may be complementary to the castellations on the control head. The castellations may be arranged in a ring.

In some embodiments, one of the control head and lock element head may comprise a single projection having bores therein. The bores may be arranged to receive complementary pins on the other of the control head and lock element head when in the inactive position such that the pins are received within the bores and thus mesh together. In the active position, the pins may not be aligned with the bores and the control element and lock element may be held apart.

In some embodiments, the projection on the control head or the projection on the lock element head may be shaped such that the rotational motion of the control element is converted to axial motion of the lock element. Thus, the projection may have a lead-in portion inclined to the axial direction arranged to bear against the other projection such that rotation of the control element moves the lock element in the axial direction. This may be advantageous as rotation of the control element can be arranged to drive the control element and lock element apart so that the lock element can engage a lock keep, for example.

In some embodiments, the control element and the lock element may be received within a housing and may be axially slidable therein. The lock mechanism may include a biasing element to urge the control element and lock element apart. The housing may form a guide such that the control element and lock mechanism can move axially relative to each other. This arrangement may be advantageous as the lock element and control element can "float" in the housing, which has been found to result in a more reliable mechanism in some cases as tolerances do not always need to be strictly controlled.

In some embodiments, the housing may comprise an abutment end plate at one end arranged to contact the control element. The abutment end plate may be constructed and adapted to form a mount for a motor for rotating the control element between the active and inactive positions. The end plate may be advantageous in some cases as it transfers forces applied to the control element to the housing rather than the forces being transferred to the motor.

In some embodiments, the control element may comprise a tubular body having the control head at one end.

In some embodiments, the tubular body of the control element may be arranged to receive a motor for rotating the control element between the active and inactive positions. The motor may be mounted to an abutment end plate of the housing. This may be advantageous in some cases since any force applied to the control element may be transferred to the abutment plate rather than through the motor.

In some embodiments, the motor may comprise a spindle to engage an aperture in the control element. The aperture and spindle may be arranged such that the spindle is axially slidable within the aperture. This may be advantageous in some cases as the spindle may be shaped such that it can rotate the control element, but it can also slide axially. This may help to isolate the motor from any forces experienced by the control element, when the lock mechanism is attacked, for example.

In some embodiments, the abutment plate may include an aperture for receiving a rod that, at a first end, engages the control element and at a second end is coupled to a motor for rotating the control element that is mounted outside of a housing of the lock mechanism. This may be advantageous in some cases as the motor is separate from the remainder of the lock mechanism. This may isolate the motor from forces subjected to the lock mechanism, especially when the rod is slidably received within the control element.

In some embodiments, the housing may comprise an aperture in one end to allow the lock element to project from the housing.

In some embodiments, the lock mechanism may include a withdrawal means for withdrawing the lock element when the control element is in the inactive position. In one example, the withdrawal means may comprise a slider projecting from the lock element. The slider may be adapted to be moved by a user to withdraw the lock element, and may be actuated by a handle. In one example, the withdrawal means may comprise a withdrawal motor arranged to withdraw the lock element. This may be advantageous as the withdrawal motor can be controlled in combination with the motor that operates the control element so that the two motors can operate together or sequentially.

In some embodiments, the lock mechanism may include two lock elements adapted to project from opposed ends and the control element may include one or more projection(s) at both ends and a middle support plate may provide support to a midsection of the control element. This may be advantageous in some cases as the middle support plate can be connected to a housing and engage a groove in the midsection of the control element. The middle support plate may provide a mount for a motor.

A first embodiment of a lock may comprise the first embodiment of the lock mechanism recited above. And further the lock element may comprise a lock bolt at one end, opposed the lock element head, for engaging a keep.

This may be advantageous in some cases because the lock mechanism can easily be integrated into a lock. The lock may be integrated in a door, a strong box, an electronic padlock, a deadbolt, a deadbolt lock or a key box, for example.

In some embodiments, the lock may include withdrawal means for withdrawing the lock bolt from the keep.

In some embodiments, the lock element and control element may be arranged such that the throw of the lock bolt is determined by the depth of the projections. Thus, the amount the projections can mesh together controls the throw of the lock bolt. This may be advantageous in some cases as the lock mechanism may only require a simple modification to suit the desired throw of the lock bolt. In some embodiments, the lock bolt may be fixedly secured to or integral with the lock element.

In some embodiments, the lock bolt may comprise a rod having a substantially flat edge for engaging the keep; a cylindrical member; or a ball bearing.

A first embodiment of a locking system for securing doors, windows, or both, of a building may include a controller and one or more lock mechanism(s). The lock mechanism(s) may be the lock mechanism of the first embodiment recited above. And the controller may be adapted to control each of the lock mechanism(s).

In some embodiments, the controller may be arranged to control each locking mechanism in response to input from an intrusion detection device.

In some embodiments, the controller may be adapted to actuate each locking mechanism wirelessly.

DRAWINGS

The following detailed description of exemplary embodiments and best mode will be set forth with reference to the accompanying drawings, in which.

Figure 1:
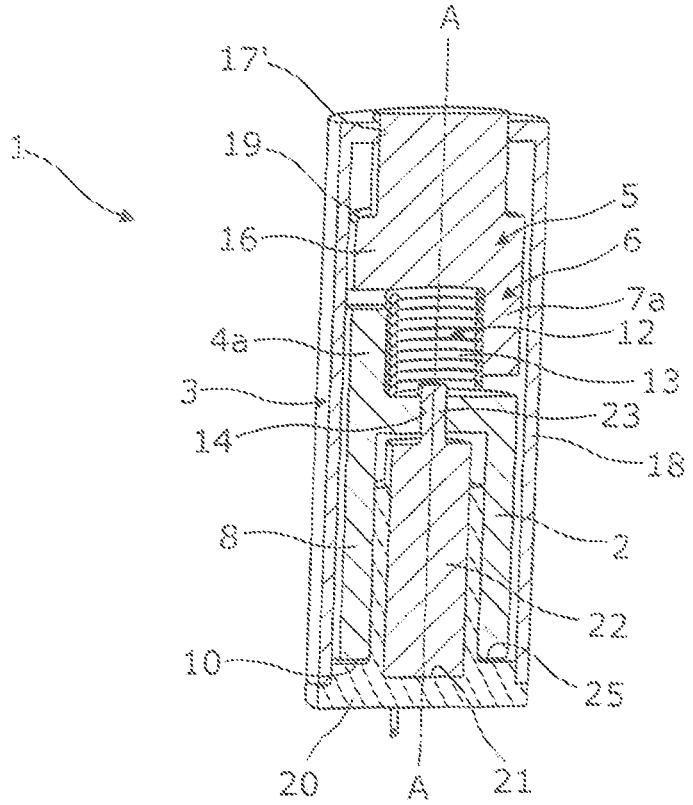
FIG. 1 shows a cross sectional view of an embodiment of a lock mechanism.
Figure 2:
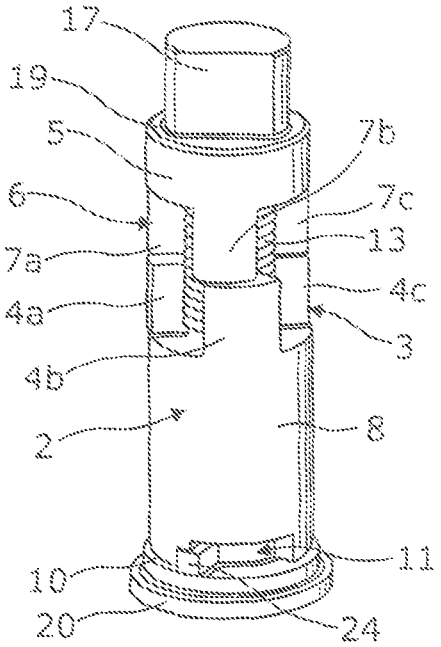
FIG. 2 shows a side view of the lock mechanism with a control element in an active position.
Figure 3:
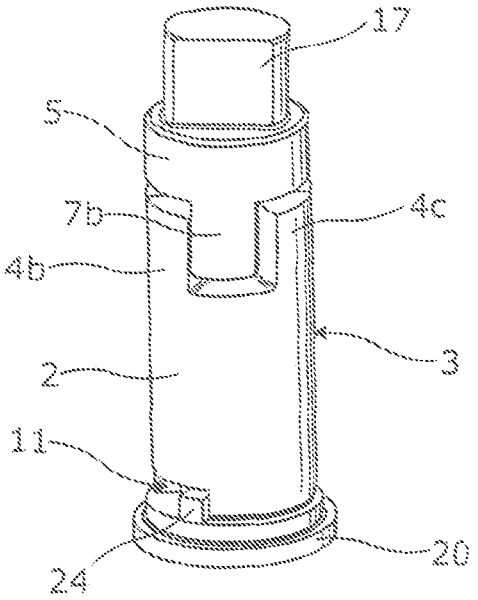
FIG. 3 shows a side view of the lock mechanism with the control element in an inactive position.
Figure 3B:
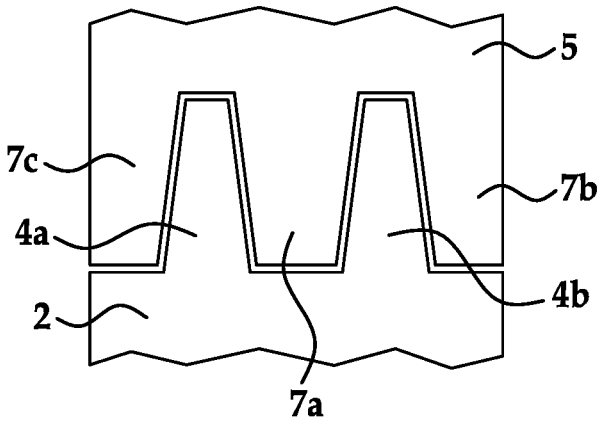
Figure 3C:
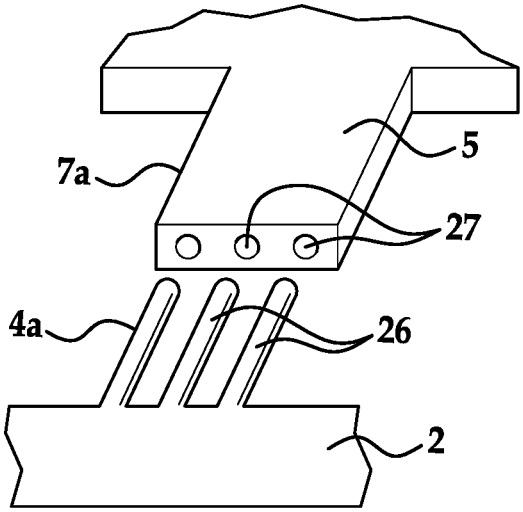
Figure 3D:
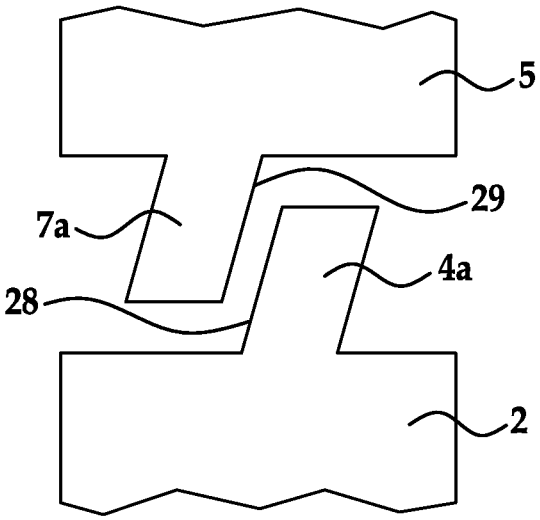
Figure 4:
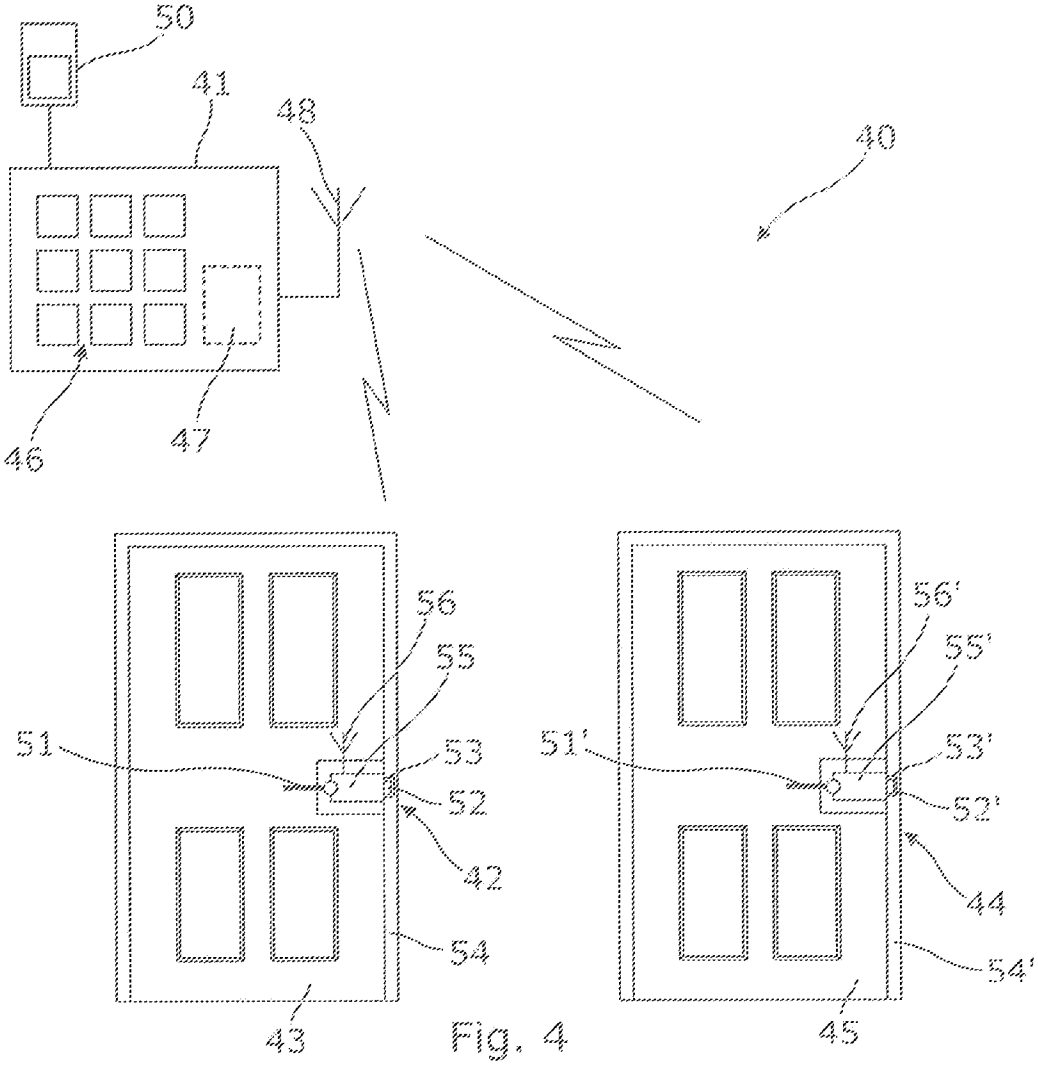

FIG. 3*b* shows an embodiment of projections of the lock mechanism with tips that are narrower than a remainder of the projections;

FIG. 3*c* shows an embodiment of projections of the lock mechanism in which a single projection has bores therein and in which complementary pins are received in the bores;

FIG. 3*d* shows an embodiment of projections of the lock mechanism in which the projections are shaped such that rotational movement of the control element is converted to axial motion of a lock element of the lock mechanism; and FIG. 4 shows an embodiment of a locking system incorporating the lock mechanisms of FIGS. 1 to 3*d*.

DETAILED DESCRIPTION

One embodiment of a lock mechanism 1 is shown in FIGS. 1 to 3, and is arranged to be integrated into a key box. It will be appreciated that the lock mechanism 1 is perfectly suited for integration into other arrangements where a robust and reliable lock mechanism is desired.

In this embodiment, the lock mechanism 1 comprises a control element 2 arranged for rotation about an axis A between an active position (shown in FIG. 2) and an inactive position (shown in FIG. 3). The control element 2 includes a control head 3 at one end having four circumferentially spaced projections 4*a-d* extending axially therefrom. Thus, the four projections have four gaps therebetween.

The lock mechanism 1 further comprises a lock element 5 that is axially aligned with the control element 2 and includes a lock element head 6. The lock element head 6 faces the control head 3. The lock element head 6 has, at its end, four circumferentially spaced projections 7*a-d* extending axially therefrom. Thus, the four projections have four gaps therebetween. The projections 4*a-d* of the control head 3 and the projections 7*a-d* of the lock element head 6 are arranged such that in the active position, the lock element 5 and control element 2 are held apart by the projections 4, 7 and in the inactive position, the projections 4 and 7 can mesh together to permit axial movement of the lock element 6 relative to the control element 2.

The control element 2 comprises a substantially tubular body 8 of circular cross-section that is closed at one end by the control head 3. At the opposite end, the control element 2 comprises an abutment rim 10. The abutment rim 10 includes a part-circumferential cut-out 11, which is used to limit the rotational movement of the control element 2, as will be described in more detail below. The projections 4 of the control head 3 form a ring of castellations. The ring of castellations defines a central region 12 of the control head 3 adapted to receive a biasing element 13 comprising, for example, a coil spring. The control head 3 also includes an aperture 14 that connects the inside of the tubular body 8 to the central region 12. The aperture 14 is keyed and in this embodiment is semicircular in cross-section.

The lock element 5 comprises a substantially cylindrical body 16. The lock element head 6 extends from a first end of the body 16. The opposed second end of the body comprises a bolt 17. The bolt 17 is arranged to fit within a keep (not shown) of the key box lock that the lock mechanism is mounted with. The lock element 5 includes withdrawal means (not visible) that allows the bolt 17 of the lock element 5 to be withdrawn. In one example, the withdrawal means comprises a withdrawal rod that extends radially so that the bolt 17 can be withdrawn by a user. The lock element 5 also includes an axially facing ledge 19 that surrounds the bolt 17.

The control element 2 and lock element 5 are slidingly mounted within a housing 18. In particular, the housing 18 provides a guiding channel in which the control element 2 and lock element 5 can slide axially. The control element 2 and lock element 5 are biased apart by the biasing element 13 and therefore "float" within the housing 18. The housing 18 has a bolt aperture 17' that allows the bolt 17 to project from the housing 18 so that it can engage the keep of the lock when in use. The bolt aperture 17' and bolt 17 are keyed to restrict rotation of the bolt 17 and therefore the lock element 5. The housing also includes a longitudinal slot (not visible) that allows the radially extending withdrawal rod to extend through the housing and move the lock element 5 when desired.

The housing 18, at an end opposed to the aperture 17', includes an abutment end plate 20. The end plate 20 includes a mounting area 21 for a motor 22. The housing 18 can be formed integrally with the abutment end plate 20, though need not, although they are shown as separate items in the Figures for clarity. The contents of the housing 18 is thus loaded therein through the end opposed to the abutment end plate 20 and then an end cap including the bolt aperture 17' is affixed to the housing by welding, for example. The motor 22 includes a spindle 23 that is received within the keyed aperture 14. The spindle 23 is also keyed so that the motor 22 can rotate the control element 2. The spindle 23, although keyed for rotation, is axially slidable in the aperture 14. The mounting area 21 is surrounded by a support track 25, which is arranged to abut the abutment rim 10. The support track 25 is annular and includes a stop peg 24. The stop peg 24 is arranged to project into the cut-out 11 and thus limits the amount that the control element 2 can rotate, as the stop peg 24 will contact the sides of the cut-out 11. This arrangement may be particularly advantageous in some cases as any force that is subjected to the housing 18 is transferred via the end plate 20 to the housing 18. The motor 22 is isolated from the force as the control element 2 is arranged to abut the end-plate and not bear on the motor 2 and the spindle 23 is axially slidable in the aperture 14.

FIGS. 2 and 3 show the lock mechanism 1 with the housing 18 removed to reveal the position of the control element 2 and lock element 5 in use. FIG. 2 shows the active position in which the control element 2 and lock element 5 are biased apart by the biasing element 13. Accordingly, the control element 2 abuts the support track 25 and the ledge 19 of the lock element 5 abuts the housing 18 adjacent the bolt aperture 17'. The control element 2 is at a rotational position where the projections 4*a-d* of the control head 2 are aligned with the projections 7*a-d* of the lock element head 6. Thus, the control element 2 and lock element 5 are restricted from moving further axially toward each other. The bolt 17 is maintained in its extended position where it extends into the keep of the key box lock (not shown). The stop peg 24 abuts a first side of the cut-out 11 in the active position. Any force that is applied to the bolt 17, such as if the lock is attacked, will be transferred to the housing 18 or through the control element 8 and the end plate 20 to the housing 18. The force on the motor 22 and spring 13 is kept to a low level so that they are not damaged. Therefore, in this embodiment it is relatively easy and cost effective to manufacture the housing 18, end plate 20, lock element 5 and control element 2 of robust materials. The arrangement of the lock mechanism 1 may be particularly advantageous in some cases as it reduces the forces on the more delicate components, which ensures reliable operation. As the structure transfers force to the housing 18, the housing can be made of a strength or thickness to suit the intended use for the lock mechanism.

Upon actuation of the motor 22, the control element 2 is rotated through approximately 45° such that is adopts the inactive position. Accordingly, the stop peg 24 now abuts an opposed side of the cut-out 11. In the inactive position, the projections 4*a-d* of the control head 2 are aligned with the gaps between the projections 7*a-d* of the lock element head 6. Likewise, the projections 7*a-d* of the lock element head 6 are aligned with the gaps between the projections 4*a-d* of the control head 2 so that the projections can move into the respective gaps. The withdrawal means rod can then be used to withdraw the lock element 5 axially towards the control element 2 such that the projections 4*a-d* mesh between the projections 7*a-d* and vice-versa. Withdrawal of the control element 2 withdraws the bolt 17 out of the keep of the key box, allowing the key box to be opened.

To lock the lock mechanism 1, the bolt 17 is returned to the keep, perhaps with manipulation of the withdrawal means. The biasing element 13 urges the control element 2 and lock element 5 apart and thus the bolt 17 adopts its extended position through the bolt aperture 17'. The projections 4*a-d* and 7*a-d* are thus no longer meshed together. The motor 22 can then be actuated to rotate the control element 2 to the active position in which the projections are aligned end to end.

It will be appreciated that although the control element 2 and the lock element 5 have been shown having four projections each, they may have more or less projections or different numbers of projections. Further, the housing and thus the control element 2 and lock element 5 are described as substantially cylindrical, although they could be alternative shapes provided that relative movement in the axial direction is possible and the control element is able to rotate about its axis. Further, the embodiment of the lock mechanism 1 described above is for integration into a key box. It will be appreciated that the lock mechanism 1 can be used in any appropriate lock where a high strength, attack resistant, simple and reliable mechanism is desired. The lock bolt 17 may comprise a ball bearing that projects though an aperture 17'. In the inactive position, the ball bearing operates as a strike mechanism and can ride into and out of the keep against the force of spring 13. When the lock mechanism is in the active position, the ball bearing is held, projecting from the lock mechanism, in the keep.

FIGS. 3*b*-3*d* show embodiments of the projections 4*a-d* and 7*a-d*.

In FIG. 3*b*, tips of the projections 4*a-d* and 7*a-d* are narrower than a remainder of the projections 4*a-d* and 7*a-d*. In FIG. 3*c*, the projection 4*a* of the control element 2 is in the form of multiple pins 26, and the projection 7*a* of the lock element 5 is in the form of a single projection with multiple bores 27 therein. The pins 26 are received in the bores 27 when in the inactive position. In a similar embodiment, the pins 26 could be provided as the projection 7*a*, and the bores 27 could be provided as the projection 4*a*. And in FIG. 3*d*, the projections 4*a-d* and 7*a-d* are shaped such that rotational motion of the control element 2 is converted to axial motion of the lock element 5. A lead-in portion 28 of the projections 4*a-d* is inclined to the axial direction, and a lead-in portion 29 of the projections 7*a-d* is inclined to the axial direction. The lead-in portions 28, 29 bear against each other and cause rotational motion of the control element 2 to be converted to axial motion of the lock element 5.

FIG. 4 shows a locking system 40 that uses the lock mechanism 1 described above. The locking system 40 is a security device for remote locking of the internal or external doors of a property, possibly in response to the detection of an unauthorised intrusion into the building. The locking system 40 in this embodiment comprises a lock control panel 41, a first lock mechanism 42 loaded into a first internal door 43 of a building and a second lock mechanism 44 loaded into a second internal door 45 of a building.

The lock control panel 41 includes a key panel 46 for receiving the input of a code, a controller 47 and an antenna 48. The controller 47 is arranged to receive a code from the key panel 46 in order to "arm" and "disarm" the controller 47. The controller 47 also receives input from an intrusion detection device 50, which may comprise a Passive Infra Red (PIR) sensor. When the controller 47 is armed, it is adapted to act on the input from the intrusion detection device 50. When it is disarmed it does not act on the input from the intrusion detection device 50. The controller 47 acts on the input by sending command signals, via the antenna 48, to the first and second lock mechanisms 42, 44. Accordingly, the controller 47 includes wireless communication means to communicate with the lock mechanisms 42, 44.

The lock mechanisms 42, 44 are similar and therefore only one lock mechanism will be described and the same reference numerals are used to describe corresponding parts but with a prime (') symbol when applied to the second lock mechanism 44 and second door 45. The lock mechanism 42, 44 has a withdrawal means in the form of a handle 51, 51'. The handle 51, 51' is able to withdraw the lock bolt 52, 52' from its keep 53, 53' when the lock mechanism is inactive. The keep is mounted in a door frame 54, 54'. When the lock mechanism is active, the lock bolt 52, 52' is held in the keep 53, 53'. The lock mechanism 42, 44 includes a lock mechanism controller 55, 55'. The lock mechanism controller is arranged to receive command signals from the controller 47 via an antenna 56, 56'. Thus, the lock mechanism controller 55, 55' includes wireless communication means. It will be appreciated that the controllers 55, 55' and antennas 56, 56' are contained with a lock unit that can be retrofitted to existing doors in place of the existing lock. This may be advantageous in some cases as the lock unit can be installed simply, with no modification to the door or the aperture in the door for the lock. The small size and high strength of the lock mechanism allows the lock unit to be a suitable size for retrofit applications.

In use, the lock mechanisms 42, 44 are normally inactive and therefore the doors 43, 45 can be opened by their handles 51, 51'. When a user arms the locking system 40 by entering a predetermined code, the controller 47 waits for input from the intrusion detection device 50. If an intrusion is detected, the controller 47 sends a control signal to the lock mechanisms 42, 44, which is received by their associated lock mechanism controllers 55, 55'. The lock mechanism controllers 55, 55' cause the motors 22 in the lock mechanisms to actuate to move the control element 2 to the active position, whereby the doors 43, 45 are locked and the withdrawal of the lock bolts 52, 52' from their respective keeps 53, 53' is prevented. This will isolate rooms in the building from the intruder as the intruder will not be able to move freely between the rooms secured by the locking system 40. The locking system 40 can be disarmed and the doors 43, 45 opened by input of the predetermined code into the key panel 46. The controller 47 then sends control signals to cause the lock mechanism controllers 55, 55' to deactivate their respective lock mechanisms.

It will be appreciated that the above description is only an example of how such a locking system could be implemented. For example, there may be more or less doors secured; more or less intrusion detection devices; different types of intrusion detection device; the use of encrypted control signals; the incorporation of anti-tampering features; the incorporation into an burglar alarm system; the use of safety systems and panic buttons to prevent legitimate occupants of the building from becoming trapped and other changes or enhancements that will be clear to those skilled in the art. One advantage of the locking system in some cases may be that the locking mechanism detailed in this description, due to its small size and high strength, can be incorporated into doors and windows to form locking systems that were previously impractical and/or expensive.

While the forms of the embodiments herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A lock mechanism comprising a control element arranged for rotation about an axis between an active position and an inactive position, the control element including a control head having at least one axially extending projection extending along the axis, the lock mechanism further comprising a lock element that is axially aligned with the control element and includes a lock element head, the lock element head having first and second opposed axial ends along the axis and at least one axially extending projection extending along the axis from an axial end face of the first axial end and toward the control head of the control element, the projection(s) of the control head and the projection(s) of the lock element head arranged such that in the active position, the lock element and control element are held apart by the projections and in the inactive position, the projections can mesh together to permit axial movement of the lock element relative to the control element, wherein the lock element comprises an elongate body having the at least one projection at the first axial end and a lock bolt at the second axial end, and wherein the lock mechanism includes a spring to urge the control element and lock element apart.

2. A lock mechanism according to claim 1, in which at least one of the projections of the control head, of the lock element head, or of both the control head and lock element head includes a tip which is narrower than a remainder of the projection.

3. A lock mechanism according to claim 1, in which the control head has at least two axially extending projections and the lock element head has a complementary number of axially extending projections.

4. A lock mechanism according to claim 1, in which at least one of the control head and the lock element head is castellated, having castellations forming the at least one projection.

5. A lock mechanism according to claim 1, in which the at least one projection of one of the control head and lock element head is a single projection having bores therein, the at least one projection of the other of the control head and the lock element head comprises complementary pins arranged to be received in the bores, in which when in the inactive position the pins are received within the bores and thus mesh together, and in the active position, the pins are not aligned with the bores and the control element and lock element are held apart.

6. A lock mechanism according to claim 1, in which the at least one projection on the control head or the at least one projection on the lock element head is shaped such that the rotational motion of the control element is converted to axial motion of the lock element.

7. A lock mechanism according to claim 6, in which the at least one projection has a lead-in portion inclined to the axial direction arranged to bear against the other at least one projection such that rotation of the control element moves the lock element in the axial direction.

8. A lock mechanism according to claim 1, in which the control element and the lock element are received within a housing, the lock element being axially slidable therein.

9. A lock mechanism according to claim 8, in which the housing comprises an abutment end plate at one end arranged to contact the control element.

10. A lock mechanism according to claim 9, in which the abutment end plate is adapted to form a mount suitable for a motor for rotating the control element between the active and inactive positions.

11. A lock mechanism according to claim 10, in which the control element comprises a tubular body having the control head at one end.

12. A lock mechanism according to claim 11, in which the tubular body receives a motor for rotating the control element between the active and inactive positions, wherein the motor is mounted to the abutment end plate of the housing.

13. A lock mechanism according to claim 12, in which the motor includes a spindle to engage an aperture in the control element, the aperture and spindle being arranged such that the spindle is axially slidable within the aperture.

14. A lock mechanism according to claim 1, in which the lock mechanism includes a withdrawal rod for withdrawing the lock element when the control element is in the inactive position.

15. The lock mechanism according to claim 1, wherein, in the active position, the at least one axially extending projection of the control head has an end perpendicular to the axis of rotation and aligned with a corresponding end of the at least one axially extending projection of the lock element head.

16. The lock mechanism according to claim 1, in which the control element comprises a tubular body closed by the control head at one end.

17. A lock comprising:

a keep; and a lock mechanism comprising a control element arranged for rotation about an axis between an active position and an inactive position, the control element including a control head having at least one axially extending projection, the lock mechanism further comprising a lock element that is axially aligned with the control element and includes a lock element head, the lock element head having first and second opposed axial ends along the axis and at least one axially extending projection extending along the axis from an axial end face of the first axial end and toward the control head of the control element, the projection(s) of the control head and the projection(s) of the lock element head arranged such that in the active position, the lock element and control element are held apart by the projections and in the inactive position, the projections can mesh together to permit axial movement of the lock element relative to the control element, wherein the lock mechanism includes a spring to urge the control element and lock element apart;

the lock element comprising a lock bolt at one end, opposite the lock element head, for engaging the keep of the lock and withdrawal rod for withdrawing the lock element when the control element is in the inactive position.

18. A locking system for securing doors or windows of a building, the locking system incorporating a controller and at least one lock mechanism, each lock mechanism comprising:

a control element arranged for rotation about an axis between an active position and an inactive position, the control element including a control head having at least one axially extending projection, the lock mechanism further comprising a lock element that is axially aligned with the control element and includes a lock element head, the lock element head having first and second opposed axial ends along the axis and at least one axially extending projection extending along the axis from an axial end face of the first axial end and toward the control head of the control element, the projection(s) of the control head and the projection(s) of the lock element head arranged such that in the active position, the lock element and control element are held apart by the projections and in the inactive position, the projections can mesh together to permit axial movement of the lock element relative to the control element, and wherein the lock element comprises an elongate body having the at least one projection at the first axial end and a lock bolt at the second axial end, and wherein the lock mechanism includes a spring to urge the control element and lock element apart;

the controller being adapted to control each lock mechanism.

19. A locking system according to claim 18, in which the controller is arranged to control each lock mechanism in response to input from an intrusion detection device.

20. A locking system according to claim 18, in which the controller is adapted to actuate each lock mechanism wirelessly.

* * * * *